United States Patent [19]

Freytag et al.

[11] 4,328,043

[45] May 4, 1982

[54] METHOD OF INCREASING SUGAR EXTRACTION EFFICIENCY FROM SUGAR-CONTAINING PLANT TISSUE WITH USE OF CARBON DIOXIDE

[75] Inventors: Arthur H. Freytag, Longmont; Rodney D. Cooke, Loveland, both of Colo.

[73] Assignee: Great Western Sugar Company, Denver, Colo.

[21] Appl. No.: 196,548

[22] Filed: Oct. 14, 1980

Related U.S. Application Data

[63] Continuation-in-part of Ser. No. 142,664, Apr. 22, 1980, abandoned.

[51] Int. Cl.[3] ..... C13D 1/08

[52] U.S. Cl. ..... 127/44; 127/43

[58] Field of Search ..... 127/43, 44

[56] References Cited

U.S. PATENT DOCUMENTS

| | | | |
|---|---|---|---|
| 2,801,940 | 8/1957 | Stark et al. . | |
| 3,313,653 | 4/1967 | Jung | 127/44 |
| 3,347,705 | 10/1967 | Jung | 127/44 |
| 3,925,097 | 12/1975 | Freytag | 127/44 |

FOREIGN PATENT DOCUMENTS 400034 10/1933 United Kingdom .

OTHER PUBLICATIONS

Sugar Industry Abstracts, vol. 31, p. 3, Abstract 69–0021 (1969).

Chemical Abstracts, 74:65904v (1971).

*Primary Examiner*—Sidney Marantz

*Attorney, Agent, or Firm*—Klaas & Law

[57] ABSTRACT

Sugar extraction efficency from sugar-containing plant tissue, such as sugarbeet cossettes or the like, is increased by contacting the sugar-containing plant tissue near the juice end of a diffusion process with diffusion water in the presence of an effective amount of carbon dioxide.

16 Claims, No Drawings

METHOD OF INCREASING SUGAR EXTRACTION EFFICIENCY FROM SUGAR-CONTAINING PLANT TISSUE WITH USE OF CARBON DIOXIDE

BACKGROUND AND SUMMARY OF THE INVENTION

This application is a continuation-in-part of application Ser. No. 06/142,664, filed Apr. 22, 1980, now abandoned.

The present invention relates to methods of recovering sugar from sugar-containing plant tissue, and more particularly to a method of increasing sugar extraction efficiency by contacting sugar-containing plant tissue with diffusion water in the presence of an effective amount of carbon dioxide.

In conventional sugar manufacturing processes, such as in the processing of sugarbeets or the like to obtain substantially pure sucrose, sugarbeets are commonly washed to remove dirt, leaves, weeds and other extraneous matter and then sliced to form long, thin strips called cossettes. In commercial processes, the cossettes are typically transported through a continuous diffuser, such as, for example, a slope-type diffuser having an elongated trough oriented in an upwardly sloping manner, in which the cossettes are transported upwardly through the trough by scrolls with perforated-plate flights or the like. Diffusion supply water, comprising, for example, factory condensate water and make-up water at temperatures above about 50° C., is typically introduced into the diffuser at its upper end and allowed to percolate by gravity downwardly through the cossettes to the lower end of the diffuser where the cossettes are initially introduced into the diffuser. In the diffuser, sugar and other soluble materials such as impurities diffuse out of the cossettes and into the diffusion water. Sugar-enriched diffusion water, known as diffusion juice or raw juice, is typically removed from the lower end of the diffuser, while spent cossettes, known as pulp, are typically removed from the upper end. Thus, in a typical diffusion process, substantially spent cossettes are contacted with diffusion supply water containing a relatively small amount of dissolved solids at or near the "pulp end" of a diffuser, while fresh, relatively high sugar content cossettes are contacted with diffusion water containing a relatively large amount of dissolved solids, such as sugar and water soluble impurities, at or near the "juice end" of the diffuser. While the foregoing diffusion process has been described in connection with a typical continuous, countercurrent slope-type diffuser, the same principles are equally applicable to other diffusion systems known in the art, e.g., chain-type diffusion systems and the like, and the other systems useful in a diffusion process for obtaining sugar from sugar-containing plant tissue.

Diffusion juice obtained in a commercial sugar manufacturing process typically comprises about 10% to about 15% sugar, which may be as much as 98% of the sugar originally contained in the cossettes. In addition, the diffusion juice typically comprises non-sucrose sugars and other non-sugar materials both as impurities in solution and other materials in colloidal suspension. The presence of non-sucrose sugars and other dissolved non-sugar, water soluble impurities, significantly adversely affects the ability to subsequently crystallize substantially pure sucrose from the diffusion juice. It is, therefore, a necessary and common commercial practice to treat the diffusion juice to remove soluble impurities and to remove undissolved solids prior to attempting to recover crystalline sucrose from the juice. Typically, the diffusion juice is initially treated with lime to cause coagulation and precipitation of a substantial portion of the undissolved solids such as colloids to cause precipitation of a portion of the soluble impurities, and to cause adsorption of other impurities on calcium carbonate crystals formed during the purification process. The limed juice is then treated with carbon dioxide gas, during a step referred to as first carbonation, to further coagulate and precipitate undissolved solids and soluble impurities, and the juice is subjected to primary separation of coagulated and precipitated solids, such as by filtration, settling and the like. The juice is then again treated with carbon dioxide gas, during a step referred to as second carbonation, in a manner designed to precipitate lime remaining in the juice as calcium carbonate. The juice is then filtered, and optionally subjected to sulfur dioxide treatment, and the purified filtrate is known as thin juice. Even after purification of the diffusion juice or raw juice, commercially produced thin juice typically comprises a substantial amount of water soluble impurities which interfere with subsequent sucrose crystallization.

After purification, the thin juice is typically evaporated to remove excess water and thereby concentrate sugar in the juice, then known as thick juice. The thick juice is then typically boiled or otherwise concentrated by water removal to further concentrate sugar in the juice and to force crystallization of sugar from the juice. The crystalized sugar may then be washed, dried and further prepared for packaging, all in a conventional manner.

In order to optimize a sugar production process, it is necessary for economic purposes to maximize overall sugar extraction, at least in part by designing sugar diffusion in such a manner as to obtain the largest economically feasible amount of sucrose while minimizing the amount of water soluble impurities in the diffusion juice. Thus, the extraction efficiency of a diffusion process is dependent upon the ability of the process to extract as much sucrose as possible from the cossettes, the ability of the process to minimize simultaneous extraction of undesirable water soluble impurities, and the ability of the process to render extracted water soluble impurities susceptible to subsequent elimination from the sugar containing juice.

Previously suggested approaches to increasing overall sugar manufacturing or recovery efficiency have included attempts to reduce impurities in the diffusion supply water, to reduce the pH of the diffusion supply water by the addition of hydrochloric and sulfuric acids, to sterilize the diffusion supply water, to optimize diffusion temperatures and cossette sizes, and the like. While such prior approaches have contributed to overall sugar recovery efficiency, further improvement of sugar extraction efficiency is desirable and if achieved can have a substantial economic effect on a commercial sugar manufacturing facility.

It has been suggested in U.S. Pat. No. 2,801,940 of Stark, et al. that the amount of colloidal materials, such as araban, pectin and proteinaceous materials, extracted from sugar beets with water containing ammonia can be reduced by addition of a sufficient amount of carbon dioxide to a diffusion system at the pulp end of a diffuser to obtain at least neutral conditions. Thus, Stark, et al. suggest obtaining reduced extraction of insoluble or colloidal materials from sugar beets with water containing ammonia through pre-treating diffusion water by adding carbon dioxide into a diffuser at the point where most of the sugar has already been extracted from the beet material and where this spent material is contacted with entering or supply water. Stark, et al. further disclose that addition of carbon dioxide at the juice end of a diffuser is ineffective and unnecessary since at the juice end, raw cossettes contain substantial quantities of betaine, amino acids and other soluble substances which exhibit buffering capacity and thereby counteract the effects of alkaline water containing ammonia on the extraction of insoluble colloidal material from the sugar beet cossettes. Stark, et al. does not disclose that the extraction of water soluble impurities from sugar-containing plant tissue could be reduced by adding carbon dioxide at any point in a diffusion process. Rather, the process disclosed by Stark, et al. adds carbon dioxide to diffusion water at a point in the diffusion process where most of the sugar and water soluble impurities have already been extracted from the beet material and are already contained in the diffusion or thin juice. The process disclosed in the Stark, et al. patent may never have attained commercial acceptance or recognition since colloidal materials and other undissolved solids are readily removed from the diffusion juice by coagulation, filtration and the like, and have not presented a common problem in the industry. The problem of obtaining increased juice purity and reducing the extraction of water soluble impurities, however, has remained.

It has been found that the efficiency of sugar extraction from sugar-containing plant tissue in a diffusion process can be significantly and unexpectedly increased by contacting the sugar-containing plant tissue near the juice end of a diffusion process with diffusion water in the presence of an effective amount of carbon dioxide. The sugar-containing plant tissue is contacted with the diffusion water in the presence of carbon dioxide near the juice end of the process where fresh or partially extracted plant tissue comes into contact with diffusion juice containing a substantial amount of water soluble, extractable sugar, and prior to a point in the diffusion process where a substantial portion of the water soluble impurities have already been extracted from the plant tissue. Increased efficiency of sugar extraction is obtained by the practice of the present invention at a relatively low economic cost.

DESCRIPTION OF THE PRESENTLY PREFERRED EMBODIMENTS

According to the present invention, sugar-containing plant tissue is contacted near the juice end of a diffusion process with diffusion water in the presence of an amount of carbon dioxide effective to increase the efficiency of sugar extraction from the plant tissue.

As used herein, the term "sugar extraction" means the ratio of the net amount of sugar recovered in a sugar manufacturing, refining or recovery process to the amount of sugar entering the process as contained in plant tissue. "Increased sugar extraction" means increasing the ratio of the net amount of sugar recovered in the sugar manufacturing, refining or recovery process to the amount of sugar entering the process. "Apparent purity" means the percentage proportion of sugar determined by direct polarization on dissolved solids, the dissolved solids being determined by refractometric methods, as are common in the industry. "True purity" means the percentage proportion of true sucrose to total soluble dry substance. Sucrose may be determined by the inversion method and total soluble dry substance by drying, as is common in the industry, or true purity may be determined by gas chromatograph. "Impurity" or "impurities" means non-sucrose dissolved solids, such as betaine, glutamine, asparagine, purines, pyrimidines, ammonia, various cations and anions, such as nitrate and chloride, and the like. "Juice end" means that end of a diffusion process where sugar enriched raw juice is removed from the process. For example, in a counter-current diffusion process, raw diffusion juice is removed from, and cossettes are introduced into, the diffusion apparatus at the juice end.

Any sugar-containing plant tissue may be treated according to the present invention. Preferably, the plant tissue comprises a relatively high concentration of the sugar which is intended to be recovered from the diffusion juice. It is presently contemplated that the most commonly recovered sugar will be sucrose. However, other mono- and dissacharides may be recovered by the practice of the present invention. Preferably particularly preferred sugar-containing plant tissue includes plant tissue derived from sugarbeets, sugar cane, sugar sorghum, and other less abundant sources of sucrose. For purposes of illustration, the presently particularly preferred embodiments of the invention are described herein in connection with the extraction and recovery of sucrose from sugarbeets.

Sugarbeets are preferably grown, harvested, washed and sliced into cossettes for subsequent diffusion, all in a conventional manner. The sugar-containing plant tissue is then contacted near the juice end of a diffusion process, and preferably at least at the point where initial contact is made between the sliced cossettes and the diffusion juice, with diffusion water in the presence of an amount of carbon dioxide effective to increase efficiency of the diffusion process. In a presently particularly preferred embodiment, the carbon dioxide used herein is initially introduced into the diffusion water near the juice end as a gas. It is contemplated, however, that the initial form of carbon dioxide employed is not critical to the successful practice of the present invention. For example, dry ice or solid carbon dioxide may be used as well as materials which in solution can be altered or acted upon to produce carbon dioxide or produce in solution the same moieties, ligands or ions produced when carbon dioxide is bubbled into the complex mixture making up the composition of the diffusion water. The exact parameters of the invention are flexible in that it appears that the beneficial aspects of the present invention are achieved by conventionally contacting the beet cossettes with diffusion water which is unconventionally modified to contain dissolved carbon dioxide at the temperatures employed. This is achieved in a presently particularly preferred embodiment of the present invention by bubbling through the diffusion water an amount of carbon dioxide gas at the temperatures and volumes of diffusion water employed in excess of the amount which would normally be soluble in that water under the same conditions.

It is, therefore, contemplated that the practice of the present invention could equally well employ carbonates, bicarbonates and other compounds which when dissolved, dispersed or otherwise present in the diffusion water, or otherwise, would in any manner, or in combination with other materials and chemicals, provide the required contact of dissolved carbon dioxide or carbon dioxide gas with the cossettes when they are initially contacted by the diffusion water. The employment of an effective amount of carbon dioxide as contemplated herein, as will be further shown hereinafter, has been found to improve the overall yield and to increase the sugar extraction efficiency of an otherwise conventional sugar extraction process.

In order to obtain the desired results, the sugar-containing plant tissue is contacted with diffusion juice in the presence of carbon dioxide near the juice end of the diffusion process, i.e., near that portion of the diffusion process where raw juice is removed from the diffusion apparatus, where fresh sugar-containing plant tissue is first introduced into the diffuser, and where the plant tissue is contacted with diffusion water or raw juice containing a substantial amount of dissolved solids, including sugar. At this point of a diffusion process when practising the present invention, a substantial portion of the water soluble impurities are surprisingly found to remain in the plant tissue. Thus, in a diffusion apparatus employing multiple cells, carbon dioxide may be introduced into the apparatus at a single cell nearest the juice end or into a plurality of cells at that end of the apparatus. It has been found that introduction of carbon dioxide into at least half of the cells of the apparatus next adjacent the juice end provides the desired results. It has been further determined that introduction of carbon dioxide solely near the pulp end of a diffusion process where a substantial portion of the water soluble impurities have already diffused out of the plant tissue and into the diffusion water will not result in the desired results of the invention.

While the precise mechanism for achieving the aforesaid benefits is not fully understood at the present time, it has been found that other factors may effect yield in the practice of the present invention. These factors include such variables as the nature and quality of the sugarbeet cossettes, the nature and type of diffusion equipment employed, and the like, which may have an effect on the amount of carbon dioxide required in a particular application. For all of the foregoing reasons, it is difficult to estimate with precision the lower limits of amounts of carbon dioxide which will be effective to achieve the desired results in all situations. Determination of such precise lower limits is within the scope of ordinary process design and choice based upon the relevant factors in a particular application. However, it has been found in one actual commercial sucrose recovery facility that as little as 1.33 lbs. of carbon dioxide gas per ton of sugarbeet cossettes bubbled into the facility's diffusion water has been effective to increase efficiency of sucrose extraction, while 0.25 lbs. of carbon dioxide gas per ton of sugarbeet cossettes has been ineffective to increase efficiency of sucrose extraction. It is therefor a presently particularly preferred embodiment to add to the diffusion water at least about 0.5, more preferably at least about 1.0 and most preferably at least about 1.25 lbs. of carbon dioxide gas per ton of sugar-containing plant tissue. Functionally equivalent amounts of solid carbon dioxide or other materials which in solution can be altered or acted upon to produce carbon dioxide or to produce the same moieties, ligands or ions produced when carbon dioxide gas is bubbled into the diffusion water may also be employed.

In a present particularly preferred embodiment, the carbon dioxide is dispersed in a uniform manner throughout the diffusion water near the juice end of the process. Uniform dispersion may be obtained by supplying the carbon dioxide into the diffuser at a plurality or multiplicity of locations near the juice end in the bottom of the diffuser, by utilizing gas dispersion nozzles at the carbon dioxide supply locations, and/or by other suitable means.

Optionally, under certain circumstances, it may be desirable to additionally treat the diffusion water, such as with a suitable mineral acid or organic acid, to lower the pH of the diffusion water. Suitable acids for this purpose would include sulfuric acid and hydrochloric acid, with sulfuric acid being presently preferred due to its subsequent relative ease of elimination and lower cost. The diffusion water may be treated with the acid of choice by adding the acid to the diffusion water supply and/or by adding the acid directly to diffusion water in the diffuser. When additional acid treatment is used, a sufficient amount of acid is added to the diffusion water or supply to lower the pH of the water to about 5.0 to about 6.5, more preferably about 5.2 to about 6.0, and most preferably about 5.4 to about 5.6. Optimum factors for particular plant varieties and conditions, and for various process variables, are readily determinable, and adjustments in process variables can be made during operation of the process when practising the present invention.

After contacting of the sugar-containing plant tissue with diffusion water in the presence of an effective amount of carbon dioxide, as hereto described, the resulting diffusion juice may be processed in a conventional manner to recover sugar from the diffusion juice.

It has been found that the contacting of sugar-containing plant tissue near the juice end of a diffusion process with diffusion water containing an effective amount of carbon dioxide results in significantly increased extraction efficiency. Increased efficiency has resulted at least in part from increased purity of the resulting diffusion and thin juiced, and additionally, in some cases, in stimulated sugar extraction from the plant tissues. It has further been found that increased extraction efficiency is obtained in a less costly and safer manner than by prior methods utilizing only hydrochloric or sulfuric acid treatment, and/or ethylene treatment, of the diffusion water.

The foregoing principles may be better understood in connection with the following illustrative examples:

EXAMPLE I

Three samples of sliced sugarbeet cossettes are treated by adding 300 grams of the cossettes per sample to 1400 ml of diffusion tap water at a temperature of 58° C. Sugar from the cossettes of Sample No. 1 is allowed to diffuse into the diffusion water without additional treatment. The pH of the diffusion water of Sample No. 2 is adjusted to 5.5 by the addition of HCl, and then ethylene gas is bubbled through the diffusion water at the rate of about 10 l./min. In Sample No. 3, substantially pure carbon dioxide gas is bubbled through the diffusion water at the rate of about 10 l./min. At 10 minute intervals, 150 ml aliquots are taken from the diffusion water of each sample for analysis of sugar content by polarimeter. The results are shown in Table I:

TABLE I

| Time | Sugar Content (%) | | |
|---|---|---|---|
| (Min.) | Sample 1 | Sample 2 | Sample 3 |
| 10 | 18.87 | 20.53 | 20.98 |
| 20 | 20.76 | 22.26 | 22.86 |
| 30 | 21.52 | 22.94 | 23.50 |

TABLE III

| Treatment | Diffusion Water Input Rate (ml/min.) | Diffusion Water Input Temp. (°C.) | Diffusion Temperatures (°C.) Pulp End | Diffusion Temperatures (°C.) Middle | Diffusion Temperatures (°C.) Juice End | Juice RDS* | Pulp Pol %* | pH of Diffusion Pulp Out | pH of Diffusion Middle | pH of Diffusion Water Out |
|---|---|---|---|---|---|---|---|---|---|---|
| Control | 160 | 83 | 74 | 72 | 77 | 12.80 | 0.93 | | | |
| $H_2SO_4$ | 138*** | 88 | 74 | 71 | 76 | 12.13 | 1.10 | 5.3 | 5.4 | 6.1 |
| $CO_2$ | 161 | 87 | 77 | 71 | 71 | 13.13 | 1.29 | 6.1 | 6.1 | 6.3 |

*"RDS" = Refractometric Dissolved Solids
**"Pulp Pol %" = Percentge of sugar remaining in pulp as measured by polarimeter
***$H_2SO_4$ is added at two locations in the diffuser to increase the total flow rate to about 160 ml./min.

TABLE I-continued

| Time (Min.) | Sugar Content (%) Sample 1 | Sample 2 | Sample 3 |
|---|---|---|---|
| 40 | 22.08 | 23.33 | 23.89 |
| 50 | 22.19 | 23.55 | 24.01 |
| 60 | 22.33 | 23.62 | 24.19 |

As shown in Table I, the ethylene/acid and carbon dioxide treated samples both demonstrate higher sugar levels in the diffusion water than the control (Sample No. 1), with the greatest sugar extraction being obtained from the carbon dioxide treated sample.

EXAMPLE II

The procedure of Example I is repeated except that the pH of the diffusion water in Sample No. 3 is adjusted to 6.0 prior to treating the sample with carbon dioxide. The results are shown in Table II:

TABLE II

| Time (Min.) | Sugar Content (%) Sample 1 | Sample 2 | Sample 3 |
|---|---|---|---|
| 10 | 12.75 | 13.85 | 14.70 |
| 20 | 14.40 | 15.60 | 16.80 |
| 30 | 15.00 | 16.30 | 17.65 |
| 40 | 15.50 | 16.90 | 18.30 |
| 60 | 15.80 | 17.30 | 19.00 |

Again, as shown in Table II, both ethylene acid and carbon dioxide acid treated samples demonstrate higher sugar levels in the diffusion water than the control. However, in this example, it appears that pretreatment of the diffusion water of Sample No. 3 to lower its pH results in even a more pronounced increase in sugar extraction during subsequent carbon dioxide treatment of the sample.

EXAMPLE III

Sliced sugarbeet cossettes are loaded into a sloped pilot plant diffuser having a throughput capacity of 20 pounds of sugarbeet cossettes per hour. The pilot plant diffuser is provided with variable temperature, feed rate and scroll rate controls, and is further provided with ports in the pilot plant body adapted to permit bubbling of a gas through the diffusion water. Three separate runs lasting eight hours each are made with the pilot plant. In the first run (control) 20 pounds of sliced sugarbeet cossettes per hour are transported through the pilot plant and are subjected to a countercurrent flow of diffusion water. In the second run, the procedure of the first run is repeated except that diffusion water is adjusted to a pH of 5.5 with $H_2SO_4$ prior to introducing the diffusion water into the pilot plant diffuser and 20 ml/min. of 0.024 N $H_2SO_4$ is added to the diffusion water in the diffuser. In the third run, the procedure of the second run is followed except that no acid is added to the diffusion water in the diffuser and carbon dioxide gas is introduced into the diffuser at a rate of 30 l./min. and is bubbled through the diffusion water. Other operating conditions for the pilot plant are shown in Table III:

The results of the pilot plant runs are shown in Table IV:

TABLE IV

| Treatment | Cossettes Sugar Content (%) | Cossettes Apparent Purity (%) | Cossettes Sugar Remaining In Pulp (%) | Thin Juice Apparent Purity (%) | Thin Juice True Purity (%)* |
|---|---|---|---|---|---|
| Control | 13.02 | 91.94 | 1.24 | 90.40 | 87.44 |
| $H_2SO_4$ | 12.98 | 91.11 | 1.03 | 90.80 | 87.29 |
| $CO_2$ | 14.06 | 91.71 | 1.21 | 93.58 | 88.63 |

*as measured by gas chromatograph

As shown in Table IV, the purity of the pilot plant thin juice is significantly increased over that of both the control and the sulfuric acid treated diffusion water, by introducing carbon dioxide into the diffusion water in the pilot plant.

EXAMPLE IV

In this example, sliced sugarbeet cossettes are introduced into a full-scale Silver Slope Diffuser, such as described in McGinnis: *Beet-Sugar Technology,* Second Edition, at pages 144–145, and are processed in a conventional commercial manner except for the addition of carbon dioxide into the diffuser system. The Silver Slope Diffuser is provided with two side by side cossette troughs and with six steam jackets which divide the troughs into six "cells", which are identified as cells 1–6; cell 1 being located adjacent the lower, cossette receiving end of the diffuser and cell 6 being located adjacent the upper, cossette discharging end of the diffuser. The body of the diffuser is adapted to permit injection of carbon dioxide gas into diffusion water in each cossette trough at six total locations: between cells 1 and 2, between cells 2 and 3, and between cells 3 and 4. The diffuser is operated over a period of several weeks in the following cyclical manner. For a period of 16 hours, the diffuser is operated in a conventional manner and data relating to the diffusion process is collected as a control. For a subsequent period of 8 hours, carbon dioxide gas is introduced into the diffuser system at the total rate of 170 lbs/hr., with 120 lbs./hr. of carbon dioxide gas being supplied through injection ports at the six locations in the diffuser troughs and 50 lbs./hr. of carbon dioxide being supplied to and dispersed in the diffusion supply water tank. The pressure of the carbon dioxide at all six injection ports is maintained at 60 lbs./sq. inch. After the 8 hr. period, it is assumed that the diffusion system has stabilized with regard to carbon dioxide treatment. For an immediately following period of 16 hours, carbon dioxide introduction into the diffuser system is continued and data is collected to determine the effects of carbon dioxide treatment on the diffusion process.

Samples are removed from the diffusion system each half-hour and are analyzed using conventional techniques to determine apparent purities, cossette sugar and cossette pulp moisture. The results, given as 16-hour averages, are shown in Table V:

TABLE V

| Run | Diffusion Juice Apparent Purity (%) | | Thin Juice Apparent Purity (%) | | 2nd Carbonation Apparent Purity (%) | | Cossette Apparent Purity (%) | | Cossette Sugar (%) | | Pulp Moisture (%) | |
|---|---|---|---|---|---|---|---|---|---|---|---|---|
| # | Control | $CO_2$ | Control | $CO_2$ | Control | $CO_2$ | Control | $CO_2$ | Control | $CO_2$ | Control | $CO_2$ |
| 1 | 84.21 | 89.47 | 88.10 | 92.10 | | | 84.24 | 85.89 | 15.15 | 15.65 | 77.94 | 77.18 |
| 2 | 86.50 | 88.44 | 89.41 | 90.30 | 88.94 | 90.79 | 86.84 | 84.96 | 15.41 | 15.14 | 78.76 | 78.03 |
| 3 | 84.69 | 87.74 | 87.86 | 91.38 | 88.98 | 91.81 | 84.99 | 87.71 | 15.08 | 15.72 | 77.89 | 76.01 |
| 4 | 88.36 | 89.17 | 90.14 | 93.10 | 91.62 | 93.22 | 87.97 | 87.92 | 16.20 | 16.67 | 79.19 | 77.10 |
| 5 | 87.58 | 88.03 | 90.97 | 91.86 | 91.02 | 91.69 | 88.15 | 89.35 | 16.10 | 16.82 | 78.35 | 77.12 |
| 6 | 88.27 | 88.64 | 91.33 | 93.36 | 91.33 | 91.45 | 83.65 | 85.33 | 16.19 | 16.14 | 79.10 | 78.05 |
| 7 | 88.33 | 88.23 | 92.19 | 92.37 | 91.02 | 91.40 | 85.79 | 85.02 | 16.19 | 16.18 | 77.74 | 76.83 |
| 8 | 90.01 | 88.13 | 92.29 | 92.16 | 92.85 | 92.37 | 87.46 | 86.99 | 16.31 | 16.49 | 78.20 | 77.09 |
| 9 | 88.36 | 88.23 | 91.89 | 91.60 | 91.32 | 91.77 | 83.65 | 87.07 | 15.78 | 15.99 | 77.22 | 76.93 |
| 10 | 86.61 | 88.74 | 91.37 | 91.97 | 90.85 | 91.32 | 86.35 | 86.53 | 15.43 | 15.31 | 77.65 | 77.19 |
| 11 | 88.26 | 91.26 | 91.96 | 93.63 | 90.30 | 93.00 | 86.27 | 85.99 | 15.71 | 15.76 | 77.83 | 77.96 |
| 12 | 89.88 | 90.01 | 90.73 | 93.20 | 90.50 | 92.75 | 86.81 | 86.50 | 16.89 | 16.24 | 80.28 | 79.59 |
| 13 | 90.11 | 89.10 | 91.36 | 94.40 | 91.10 | 93.50 | 86.68 | 86.83 | 15.78 | 16.42 | 80.00 | 77.35 |

The means, difference and statistical significance for this data is shown in Table VI:

TABLE VI

| Quantity | Treatment Control | Treatment $CO_2$ | Difference | Significance |
|---|---|---|---|---|
| Apparent Purity (%): | | | | |
| Diffusion Juice | 87.78 | 88.86 | 1.08 | 0.070 N.S. |
| Thin Juice | 90.74 | 92.42 | 1.68 | 0.005 V.S. |
| 2nd Carb. Juice | 90.82 | 92.08 | 1.27 | 0.005 V.S. |
| Cossette Purity | 86.07 | 86.62 | 0.57 | — N.S. |
| Cossette Sugar Content | 15.86 | 16.04 | 0.18 | — N.S. |
| Pulp Moisture | 78.47 | 77.47 | 1.00 | 0.001 V.S. |

N.S.—Not significant at 0.05 level
V.S.—Very significant at 0.01 level

As shown in Tables V and VI, carbon dioxide treatment in a commercial diffusion facility results in increased diffusion juice apparent purity, thin juice apparent purity, and second carbonation juice apparent purity. In addition, carbon dioxide treatment results in cossette pulp having a reduced moisture content which results in further savings in subsequent pulp pressing.

EXAMPLE V

Two sets of pint containers having six jars to a set are filled with 250 ml of tap water and maintained at 60° C. The containers jars of each set are sequentially identified as cells 1, 2, 3, 4, 5, and 6, respectively. 150 gm. of freshly sliced sugarbeet cossettes are added to the water in each cell 1. At ten minute intervals, the cossettes from each cell 1 are transferred to the corresponding cell 2 and an additional 150 gm. of freshly sliced cossettes are added to the water in each cell 1. This procedure is followed until the cossettes have reached each cell 6. At following ten minute intervals, an additional pint container containing 250 ml of tap water at 60° C. is added to each set, the new jars becoming cell 6 of each set and the remaining cells descending in the sequence of the set. The initial cell of each set being displaced from the position of cell 1 is removed from the sets for analysis of the diffusion water. In one of the sets of cells, carbon dioxide is continuously sparged to excess through cell 1 of the set (i.e., at the juice end of the diffusion process). In the second set of cells, carbon dioxide is continuously sparged to excess through cell 6 of the set (i.e, at the pulp end of the process).

The cells removed from the sets at ten minute intervals are analyzed for thin juice apparent purity using a modified Carruther's method. The results are shown in Table VII:

TABLE VII

| Minutes From Start of Sampling | $CO_2$ Introduced in Cell 6 (Pulp End) | $CO_2$ Introduced in Cell 1 (Juice End) |
|---|---|---|
| 10 | 96.39 | 97.23 |
| 20 | 87.71 | 87.82 |
| 30 | 82.48 | 91.39 |
| 40 | 89.18 | 92.01 |
| 50 | 84.44 | 90.90 |
| 60 | 92.57 | 91.34 |
| 70 | 84.35 | 94.08 |
| 80 | 87.01 | 92.87 |
| Mean | 88.02 | 92.21 |

From the results shown in Table VII, introduction of carbon dioxide gas near the juice end of the diffusion process results in a thin juice purity increase of over 4 percentage points over introduction of carbon dioxide gas near the pulp end of the process.

EXAMPLE VI

The procedure of Example V is repeated except that the water in each cell of each set is adjusted to a pH of 9.5 by the addition of ammonium hydroxide prior to contacting the cossettes with the water. The results are shown in Table VIII:

TABLE VIII

| Minutes From Start of Sampling | $CO_2$ Introduced in Cell 6 (Pulp End) | $CO_2$ Introduced in Cell 1 (Juice End) |
|---|---|---|
| 10 | 100.00 | 101.00 |
| 20 | 81.89 | 88.20 |
| 30 | 82.74 | 80.07 |
| 40 | 82.96 | 85.07 |
| 50 | 86.83 | 89.59 |
| 60 | 82.43 | 87.81 |
| 70 | 83.88 | 87.56 |
| 80 | 84.26 | 87.26 |
| Mean | 85.62 | 88.32 |

EXAMPLE VII

The procedure of Example VI is repeated using three sets of cells. In one set of cells, carbon dioxide gas is sparged to excess through the water in cell 1 of the set (i.e., near the juice end). In a second set of cells, carbon dioxide gas is sparged to excess through the water in cell 6 of the set (i.e., near the pulp end). In the last set, no carbon dioxide is added to any cell of the set. The results are shown in Table IX:

TABLE IX

| Minutes From Start Sampling | No $CO_2$ Addition | $CO_2$ Introduced in Cell 6 (Pulp End) | $CO_2$ Introduced in Cell 1 (Juice End) |
|---|---|---|---|
| 10 | 80.20 | 82.75 | 86.66 |
| 20 | 84.64 | 81.75 | 89.08 |
| 30 | 86.44 | 83.48 | 92.69 |
| 40 | 88.30 | 86.10 | 93.31 |
| 50 | 85.62 | 85.66 | 94.37 |
| 60 | 89.92 | 86.20 | 92.09 |
| Mean | 85.85 | 84.32 | 91.37 |

As shown in Table IX, addition of carbon dioxide in cell 6, i.e., at the pulp end of a diffusion process, appears to lower the thin juice apparent purity over that obtained with no $CO_2$ addition by about 1.5 percentage points, whereas addition of carbon dioxide to cell 1, i.e., at the juice end of a diffusion process, appears to raise the thin juice apparent purity by about 5.5 percentage points.

The invention has heretofore been described in connection with presently particularly preferred illustrative embodiments. Various modifications of the inventive concepts may be apparent from this description. Any such modifications are intended to be within the scope of the appended claims except insofar as precluded by the prior art.

What is claimed is:

1. A method of extracting sugar from sugar-containing plant tissue comprising contacting sugar-containing plant tissue near the juice end of a diffusion process with diffusion water in the presence of an amount of carbon dioxide effective to increase the efficiency of sugar extraction from the plant tissue, said carbon dioxide being added directly to the diffusion water.

2. The method of claim 1 wherein carbon dioxide gas is bubbled through the diffusion water.

3. The method of claim 2 which further comprises dispersing carbon dioxide gas in the diffusion water prior to contacting the plant tissue with the diffusion water.

4. The method of claim 1 which further comprises adjusting the pH of the diffusion water to about 5.0 to about 6.5.

5. The method of claim 4 wherein the pH of the diffusion water is adjusted to about 5.2 to about 6.0.

6. The method of claim 5 wherein the pH of the diffusion water is adjusted by adding sulfuric acid to the diffusion water.

7. A method of increasing the efficiency of sucrose extraction from plant tissue derived from the group consisting of sugarbeets, sugar cane, sugar sorghum and mixtures thereof comprising contacting the plant tissue near the juice end of a diffusion process with diffusion water in the presence of an amount of carbon dioxide gas effective to increase the efficiency of sucrose extraction from the plant tissue, said carbon dioxide being added directly to the diffusion water.

8. The method of claim 7 wherein carbon dioxide gas is bubbled through the diffusion water.

9. The method of claim 8 wherein at least about 0.5 lbs. of carbon dioxide per ton of plant tissue is bubbled through the diffusion water.

10. The method of claim 8 wherein at least about 0.75 lbs. of carbon dioxide per ton of plant tissue is bubbled through the diffusion water.

11. The method of claim 8 wherein at least about 1.0 lbs. of carbon dioxide per ton of plant tissue is bubbled through the diffusion water.

12. The method of claim 8 which further comprises adjusting the pH of the diffusion water to about 5.0 to about 6.5.

13. The method of claim 12 wherein the pH of the diffusion water is adjusted to about 5.2 to about 6.0.

14. The method of claim 13 wherein the pH of the diffusion water is adjusted by adding sulfuric acid to the diffusion water.

15. A method of extracting sugar from sugar-containing plant-tissue comprising contacting sugar-containing plant tissue near the juice end of a diffusion process with diffusion water in the presence of an amount of an agent selected from the group consisting of carbon dioxide gas, dissolved carbon dioxide, materials which are acted upon in the diffusion water to produce the same moities, ligands or ions produced when carbon dioxide is bubbled into the diffusion water, and mixtures thereof, effective to increase the efficiency of sugar extraction from the plant tissue.

16. A method of inhibiting extraction of water soluble impurities from sugar-containing plant tissue in a sugar diffusion process, comprising contacting sugar-containing plant tissue near the juice end of a diffusion process with diffusion water in the presence of an amount of carbon dioxide effective to inhibit the extraction during the diffusion process of water soluble impurities from the plant tissue.

* * * * *